US007758145B2

(12) United States Patent
Johnson

(10) Patent No.: US 7,758,145 B2
(45) Date of Patent: Jul. 20, 2010

(54) LONG TERM MAINTENANCE FOR INK JET PRINTHEAD

(75) Inventor: Martin Alan Johnson, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 1151 days.

(21) Appl. No.: 10/955,249

(22) Filed: Sep. 29, 2004

(65) Prior Publication Data

US 2006/0066660 A1 Mar. 30, 2006

(51) Int. Cl.
*B41J 29/393* (2006.01)
*B41J 2/165* (2006.01)

(52) U.S. Cl. ..... 347/19; 347/23; 347/30; 347/33

(58) Field of Classification Search ..... 347/19, 347/23, 30, 33
See application file for complete search history.

(56) References Cited

U.S. PATENT DOCUMENTS 4,540,997 A 9/1985 Biggs et al.
4,947,187 A 8/1990 Iwagami
5,572,242 A 11/1996 Fujii et al.
5,828,389 A 10/1998 Yamaguchi et al.
5,847,726 A * 12/1998 Hori ..... 347/33
5,900,889 A 5/1999 Tsukuda
5,940,185 A 8/1999 Inoue et al.
5,942,043 A 8/1999 Suemune
6,042,218 A * 3/2000 Nakahara ..... 347/35
6,120,126 A 9/2000 Nakahara
6,227,646 B1 5/2001 Yano et al.
6,364,448 B2 4/2002 Nishioka et al.
6,746,097 B2 6/2004 Im et al.
6,749,282 B2 6/2004 Kohno
2002/0127040 A1 * 9/2002 Davies et al. ..... 400/76
2002/0196304 A1 12/2002 Gomez et al.

* cited by examiner

*Primary Examiner*—Matthew Luu
*Assistant Examiner*—Jannelle M Lebron

(57) ABSTRACT

A method of performing periodic maintenance on a printhead in an ink jet printer, includes the steps of: applying electrical power to the ink jet printer at a start time; determining an elapsed time since the start time; comparing the elapsed time with a determinate time period; and performing a printhead maintenance routine, after the elapsed time reaches the determinate time period, and independent of usage of the printhead.

17 Claims, 2 Drawing Sheets

LONG TERM MAINTENANCE FOR INK JET PRINTHEAD

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to an ink jet printer, and, more particularly, to a method of performing printhead maintenance in an ink jet printer.

2. Description of the Related Art

Ink jet printers typically employ a reciprocating carriage supporting one or more printheads. The printheads are capped in a maintenance station when not in use. If the printheads are used frequently, ink is being fired through the nozzles at a rate such that the ink will not clog up and harden over time, or grow crystals in the ink. If the printheads are not used frequently, the long-term inactive period allows the nozzles to clog due to evaporation, ink crystal growth, and/or settling of the ink particles. The nozzle clogs diminish print quality, and depending on the period of time, can cause the printhead to fail beyond recovery. In addition, the use of pigment inks can accelerate the failure of nozzles due to clogs.

Printhead maintenance requires periodic jetting, sometimes called spitting, of ink droplets to clear contamination from nozzles or to ensure proper ink chemistry at the nozzle openings. The droplets are frequently collected in a waste ink reservoir called a spittoon. This ink droplet firing, as a part of a maintenance algorithm, occurs to clear the printhead nozzles of contamination or to prevent ink chemistry changes at the nozzle openings due to crusting, viscosity changes, or separation of ink constituents. For example, during printhead spit maintenance, the printhead may be moved by the carrier to a fixed location, and the printhead fires into the fixed location. The fixed location may be, for example, an open waste ink reservoir, a waste ink collection surface, or a foam filled spit tower, positioned outside the print zone of the printer.

A known method of initiating a printhead maintenance routine is to monitor printhead usage, e.g., the number of times that the nozzle heaters are fired. When the printhead usage reaches a predetermined threshold level, the printhead maintenance routine is initiated. This method of initiating printhead maintenance is effective, but may be computationally expensive and requires memory to monitor printhead usage on a total or per nozzle heater basis.

SUMMARY OF THE INVENTION

The present invention provides a method of performing periodic maintenance on a printhead, in which the maintenance is performed dependent only upon an amount of elapsed time since printer power-up.

The invention comprises, in one form thereof, a method of performing periodic maintenance on a printhead in an ink jet printer, including the steps of: applying electrical power to the ink jet printer at a start time; determining an elapsed time since the start time; comparing the elapsed time with a determinate time period; and performing a printhead maintenance routine, after the elapsed time reaches the determinate time period, and independent of usage of the printhead.

An advantage of the present invention is that only a time period since power-up need be monitored, and other parameters related to printhead usage need not be monitored. Another advantage is that monitoring only the elapsed time since power-up is simpler and computationally less expensive.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

The exemplification set out herein illustrates one preferred embodiment of the invention, in one form, and such exemplification is not to be construed as limiting the scope of the invention in any manner.

DETAILED DESCRIPTION OF THE INVENTION

Figure 1:
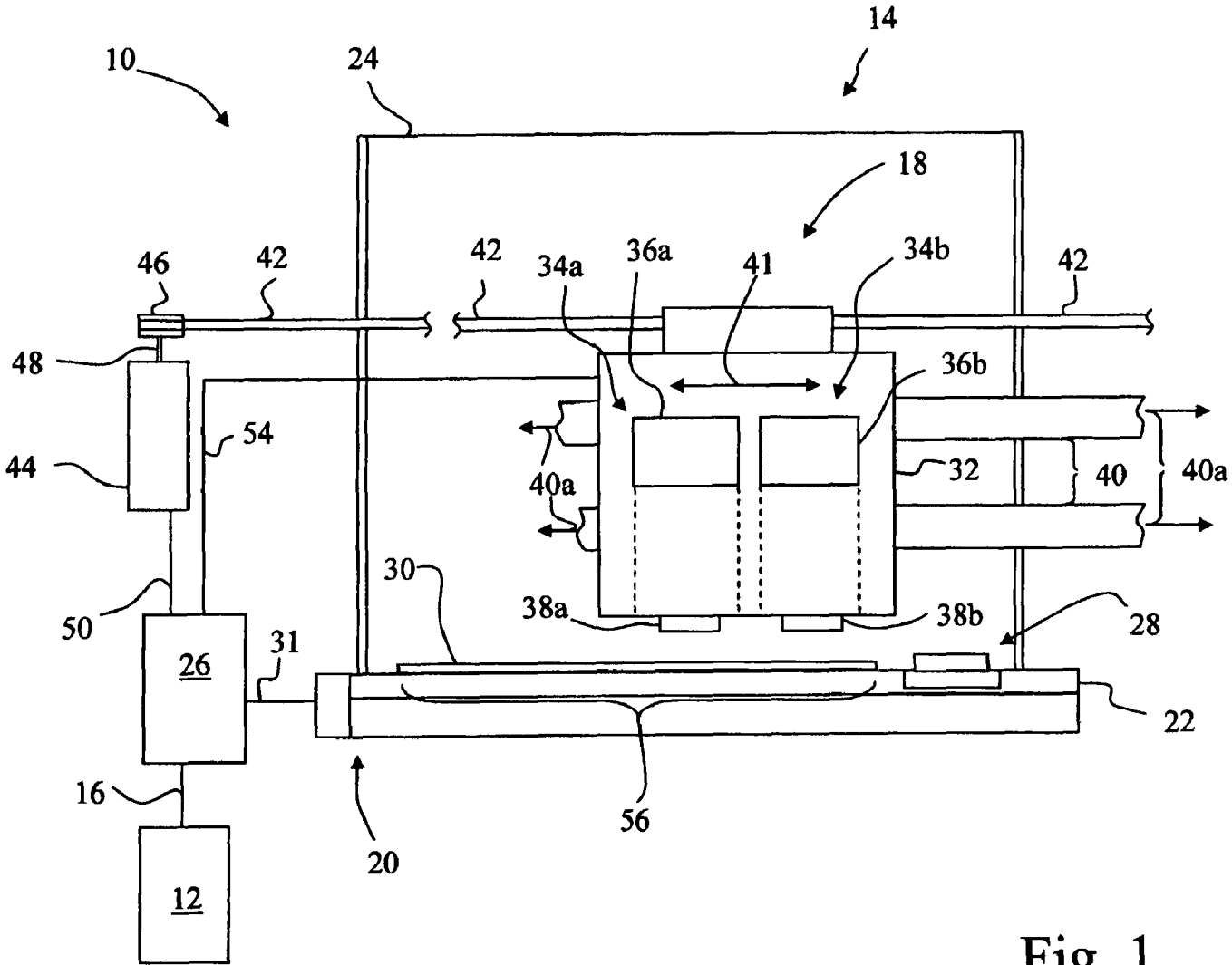
FIG. 1 is a diagrammatic representation of an imaging system which may be used with the method of printhead maintenance of the present invention.

Referring now to the drawings and particularly to FIG. 1, there is shown an imaging system 10 employing an embodiment of the present invention. Imaging system 10 includes a host 12 and an imaging apparatus in the form of an ink jet printer 14. Host 12 is communicatively coupled to ink jet printer 14 by way of communications link 16. Communications link 16 may be, for example, a wired connection, a wireless connection, such as an optical or r.f. connection, or a network connection, such as an Ethernet Local Area Network.

Host 12 can be, for example, a personal computer of a type that is well known in the art, and includes a monitor to display graphics or text, an input device such as a keyboard and/or mouse, a microprocessor and associated memory, such as random access memory (RAM), read only memory (ROM) and a mass storage device, such as CD-ROM or DVD hardware. Resident in the memory of host 12 is printer driver software. The printer driver software places print data and print commands in a format that can be recognized by ink jet printer 14. Host 12 is shown only for exemplary purposes as part of a typical system. The functions provided by host 12 can also be incorporated into other elements of the system 10 such as controller 26, described herein.

Ink jet printer 14 includes a printhead carrier system 18, a feed roller unit 20, a mid-frame 22, a media source 24, a controller 26 and a waste ink receptacle 28. Waste ink receptacle 28 may be located, for example, on or adjacent to mid-frame 22. Also, ink jet printer 14 may serve as the printing mechanism in a multi-function apparatus, such as an apparatus capable of performing copying and faxing, in addition to printing. Such multi-function apparatuses can perform printing functions without the need for a host.

Media source 24 is configured and arranged to supply from a stack of print media a sheet of print media 30 to feed roller unit 20. Feed roller unit 20 in turn further transports the sheet of print media 30 during a printing operation, under the control of controller 26, via a communications link 31.

Printhead carrier system 18 includes a printhead carrier 32 that carries, for example, one or more printhead cartridges, such as a monochrome printhead cartridge 34*a* and/or a color printhead cartridge 34*b* that is mounted thereto. Monochrome printhead cartridge 34*a* includes a monochrome ink reservoir 36*a* provided in fluid communication with a monochrome inkjet printhead 38*a*. Color printhead cartridge 34*b* includes a color ink reservoir 36*b* provided in fluid communication with a color ink jet printhead 38*b*. Alternatively, ink reservoirs 36*a*, 36*b* may be located off-carrier, and coupled to respective ink jet printheads 38*a*, 38*b* via respective fluid conduits. Also, alternatively, monochrome printhead cartridge 34*a* may be replaced by a photo printhead cartridge that may include additional ink colors and/or formulations and/or use different ink drop sizes.

Printhead carrier 32 is guided by a pair of guide members 40. Either, or both, of guide members 40 may be, for example, a guide rod, or a guide tab formed integral with a frame portion of ink jet printer 14. The axes 40*a* of guide members 40 define a bi-directional scanning path 41 of printhead carrier 32. Printhead carrier 32 is connected to a carrier transport belt 42 that is driven by a carrier motor 44 via a carrier pulley 46. Carrier motor 44 has a rotating motor shaft 48 that is attached to carrier pulley 46. In this manner, carrier motor 44 is drivably coupled to printhead carrier 32, although one skilled in the art will recognize that other drive coupling arrangements could be substituted for the example given, such as for example, a worm gear drive. Carrier motor 44 can be, for example, a direct current motor or a stepper motor. Carrier motor 44 is coupled, e.g., electrically connected, to controller 26 via a communications link 50.

Ink jet printheads 38*a*, 38*b* are electrically connected to controller 26 via a communications link 54. Controller 26 supplies electrical address and control signals to ink jet printer 14, and, in particular, to ink jet printheads 38*a*, 38*b* to selectively fire the nozzle heaters of ink jet printheads 38*a*, 38*b*, so as to effect the selective ejection of ink from ink jet printheads 38*a*, 38*b*. Such selective firing of the nozzle heaters of ink jet printheads 38*a*, 38*b* may occur during normal printing, and may occur during the printhead maintenance method of the present invention.

At a directive of controller 26, printhead carrier 32 is transported in a controlled manner along bi-directional scanning path 41, via the rotation of carrier pulley 46 imparted by carrier motor 44, in a reciprocating manner. The reciprocation of printhead carrier 32 transports ink jet printheads 38*a*, 38*b* across the sheet of print media 30 along bi-directional scanning path 41 to define a print zone 56 of ink jet printer 14. The width of print zone 56 corresponds generally to the width of the sheet of print media 30. Accordingly, waste ink receptacle 28 may be formed, for example, by an open waste ink reservoir, a waste ink collection surface, or a foam filled spit tower, that is positioned outside print zone 56 along mid-frame 22 of ink jet printer 14.

Figure 2:
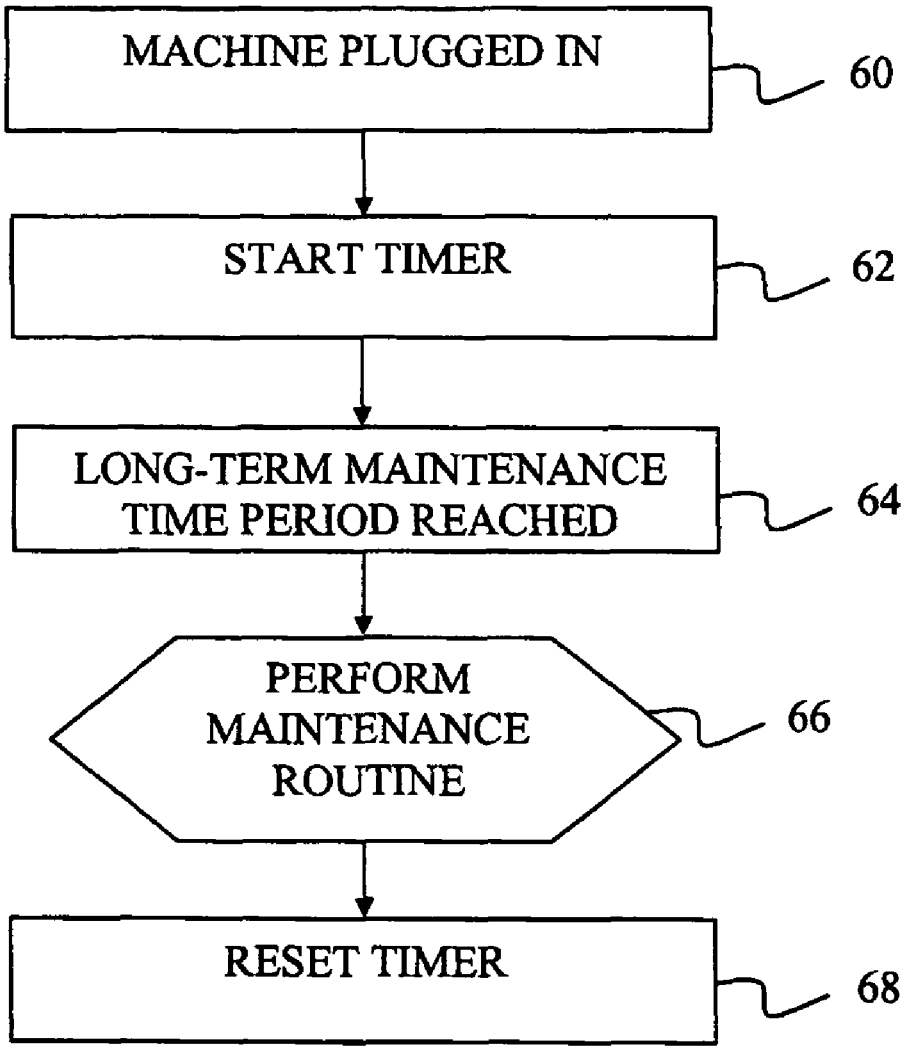
FIG. 2 is a flow chart of an embodiment of the method of the present invention for carrying out long term printhead maintenance.

Referring now to FIG. 2, the long term printhead maintenance method of the present invention will be described in greater detail. In contrast with known methods which initiate a printhead maintenance routine dependent upon usage of the printhead, the method of the present invention is initiated totally independent of printhead usage. Instead, an elapsed time is determined from a start time since ink jet printer 14 is plugged in and connected to a source of electrical power (blocks 60 and 62). For example, the elapsed time can be determined within a clock or counter within an Application Specific Integrated Circuit (ASIC) forming part of controller 26. The elapsed time is compared with a value of a determinate time period which is stored in a memory of ink jet printer 14. This determinate time period is preselected to initiate the printhead maintenance routine at a point in time after printer plug in so as to avoid nozzle clogging, etc. described above.

After the elapsed time has reached the predeterminate time period (block 64), a printhead maintenance routine is performed in ink jet printer 14, independent of printhead usage (block 66) depending upon the state of the printer. The printhead maintenance routine is typically carried out when the printer is in a non-printing state so as not to interfere with a printing operation even though the printhead maintenance routine could also be performed during printing by pausing the print job. During the printhead maintenance routine, the nozzle heaters in the printhead are fired a predetermined number of times in a waste ink area, preferably with each nozzle heater being fired a same number of times. Again, the number of times that the nozzle heaters are fired is a predetermined number, independent of printhead usage. The printhead maintenance routine also preferably includes a wiping action which is carried out on the printhead against a wiping surface, either before or after the nozzle heater firings.

After the printhead maintenance routine is completed, the start time for determining the elapsed time is reset to zero (block 68). The elapsed time is then again monitored and compared with the value of the determinate time period. When the elapsed time reaches the determinate time period, the printhead maintenance routine is repeated when ink jet printer 14 is in a non-printing state.

The time period between printhead maintenance routines and the number of nozzle fires that occur during a printhead maintenance routine is empirically determined by testing. The type of ink used, the type of printhead, nozzle structure, ink flow path are some of the factors that effect the period and number of nozzle firings used. For example, for cartridges having dye-based inks, a monochrome (e.g., black) cartridge can have each nozzle fired about one thousand times while a dye-based color cartridge would have each nozzle fired about one order of magnitude more times. It is expected that a pigmented color cartridge would have nozzle firings ranging in number from about that used for a monochrome cartridge to about one half that used for a dye-based color cartridge. The period between printhead maintenance routines can be, for example, several days to over a week.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of performing periodic maintenance on a printhead in an ink jet printer, comprising the steps of:

applying electrical power to said ink jet printer at a start time;

determining an elapsed time since said start time; and performing a printhead maintenance routine, dependent upon said elapsed time, and independent of usage of said printhead;

establishing a determinate time period, said step of performing said printhead maintenance routine being carried out after said elapsed time reaches said determinate time period;

resetting said start time to zero after said step of performing said printhead maintenance routine; and repeating said steps of determining said elapsed time, and performing said printhead maintenance routine.

2. The method of claim 1, wherein said step of performing said printhead maintenance routine includes the substep of determining a printing state of said ink jet printer, said step of performing said printhead maintenance routine being carried out dependent upon said ink jet printer being in a non-printing state.

3. The method of claim 1, wherein said printhead maintenance routine includes firing nozzle heaters in said printhead a predetermined number of times, independent of said printhead usage.

4. The method of claim 3, wherein said printhead maintenance routine includes wiping said printhead.

5. The method of claim 3, wherein each said nozzle heater in said printhead is fired a same number of times.

6. The method of claim 1, wherein said step of determining an elapsed time is carried out using one of a clock and a counter.

7. The method of claim 1, wherein said step of applying electrical power includes plugging in said ink jet printer to a source of electrical power.

8. A method of performing periodic maintenance on a printhead in an ink jet printer, comprising the steps of:

applying electrical power to said ink jet printer at a start time;

determining an elapsed time since said start time;

comparing said elapsed time with a determinate time period; and performing a printhead maintenance routine, after said elapsed time reaches said determinate time period, and independent of usage of said printhead;

resetting said start time to zero after said step of performing said printhead maintenance routine; and repeating said steps of determining said elapsed time, and performing said printhead maintenance routine.

9. The method of claim 8, wherein said step of performing said printhead maintenance routine includes the substep of determining a printing state of said ink jet printer, said step of performing said printhead maintenance routine being carried out dependent upon said ink jet printer being in a non-printing state.

10. The method of claim 8, wherein said printhead maintenance routine includes firing nozzle heaters in said printhead a predetermined number of times, independent of said printhead usage.

11. The method of claim 10, wherein said printhead maintenance routine includes wiping said printhead.

12. The method of claim 10, wherein each said nozzle heater in said printhead is fired a same number of times.

13. The method of claim 8, wherein said step of determining an elapsed time is carried out using one of a clock and a counter.

14. The method of claim 8, wherein said step of applying electrical power includes plugging in said ink jet printer to a source of electrical power.

15. A method of performing periodic maintenance on a printhead in an ink jet printer, comprising the steps of:

applying electrical power to said ink jet printer at a start time;

determining an elapsed time since said start time;

comparing said elapsed time with a determinate time period;

determining a printing state of said ink jet printer, said printing state being one of a printing state and a non-printing state; and upon said ink jet printer being in a non-printing state and after said elapsed time reaches said determinate time period and independent of usage of said printhead, performing a printhead maintenance routine, comprising:

firing nozzle heaters in said printhead a predetermined number of times, independent of said printhead usage; and wiping said printhead;

resetting said start time to zero after said step of performing said printhead maintenance routine; and repeating said steps of determining said elapsed time, and performing said printhead maintenance routine.

16. The method of claim 15 wherein the printhead comprises a monochrome printhead and a dye-based color printhead and the number of firings of nozzle heaters in said monochrome printhead is about an order of magnitude less than the number of firings of the nozzle heaters in said dye-based color printhead.

17. The method of claim 15 wherein the printhead comprises a monochrome printhead and a pigment-based color printhead and the number of firings of nozzle heaters in said monochrome printhead is about the same order of magnitude as the number of firings of the nozzle heaters in said pigment-based color printhead.

* * * * *